US008157493B2

(12) United States Patent
Kim

(10) Patent No.: US 8,157,493 B2
(45) Date of Patent: Apr. 17, 2012

(54) BOOK BINDING DEVICE

(75) Inventor: Seong-Hoon Kim, Seoul (KR)

(73) Assignees: KRDC Co., Ltd., Seoul (KR); Gradco (Japan) Ltd., Tokyo (JP)

( * ) Notice: Subject to any disclaimer, the term of this patent is extended or adjusted under 35 U.S.C. 154(b) by 175 days.

(21) Appl. No.: 12/554,586

(22) Filed: Sep. 4, 2009

(65) Prior Publication Data

US 2010/0158638 A1 Jun. 24, 2010

(30) Foreign Application Priority Data

Dec. 19, 2008 (KR) ..... 10-2008-0129771

(51) Int. Cl.

| | |
|---|---|
| ***B42C 9/00*** | (2006.01) |
| ***B42C 5/08*** | (2006.01) |
| ***B42C 11/00*** | (2006.01) |
| ***B42C 11/02*** | (2006.01) |
| ***B42C 5/00*** | (2006.01) |

(52) U.S. Cl. ..... 412/33; 412/1; 412/6; 412/7; 412/8; 412/9; 412/16; 412/18; 412/19; 412/25; 412/28; 412/32; 412/37

(58) Field of Classification Search ..... 412/1, 6, 412/7, 8, 9, 16, 18, 19, 25, 28, 29, 32, 33, 412/37

See application file for complete search history.

(56) References Cited

U.S. PATENT DOCUMENTS 5,961,268 A * 10/1999 Jager ..... 412/32
2009/0148215 A1 * 6/2009 Takahashi et al. ..... 412/19

* cited by examiner

*Primary Examiner* — Dana Ross
*Assistant Examiner* — Justin Lewis
(74) *Attorney, Agent, or Firm* — Birch, Stewart, Kolasch & Birch, LLP

(57) ABSTRACT

A milling unit of a book binding device removes a coating material adhered to cutting surfaces of coating sheets. A book binding device binding a bunch of sheets fed from a sheet aligning unit includes a sheet aligning plate aligning a section of the bunch of sheets fed from the sheet aligning unit; a gripper fixing the bunch of sheets aligned by the sheet aligning plate; an adhesive unit feeding an adhesive member to the section of the bunch of sheets to bind the bunch of sheets; and a milling unit milling the section of the bunch of sheets before the bunch of sheets is subjected to binding by the adhesive unit.

2 Claims, 13 Drawing Sheets

【FIG 1】
PRIOR ART
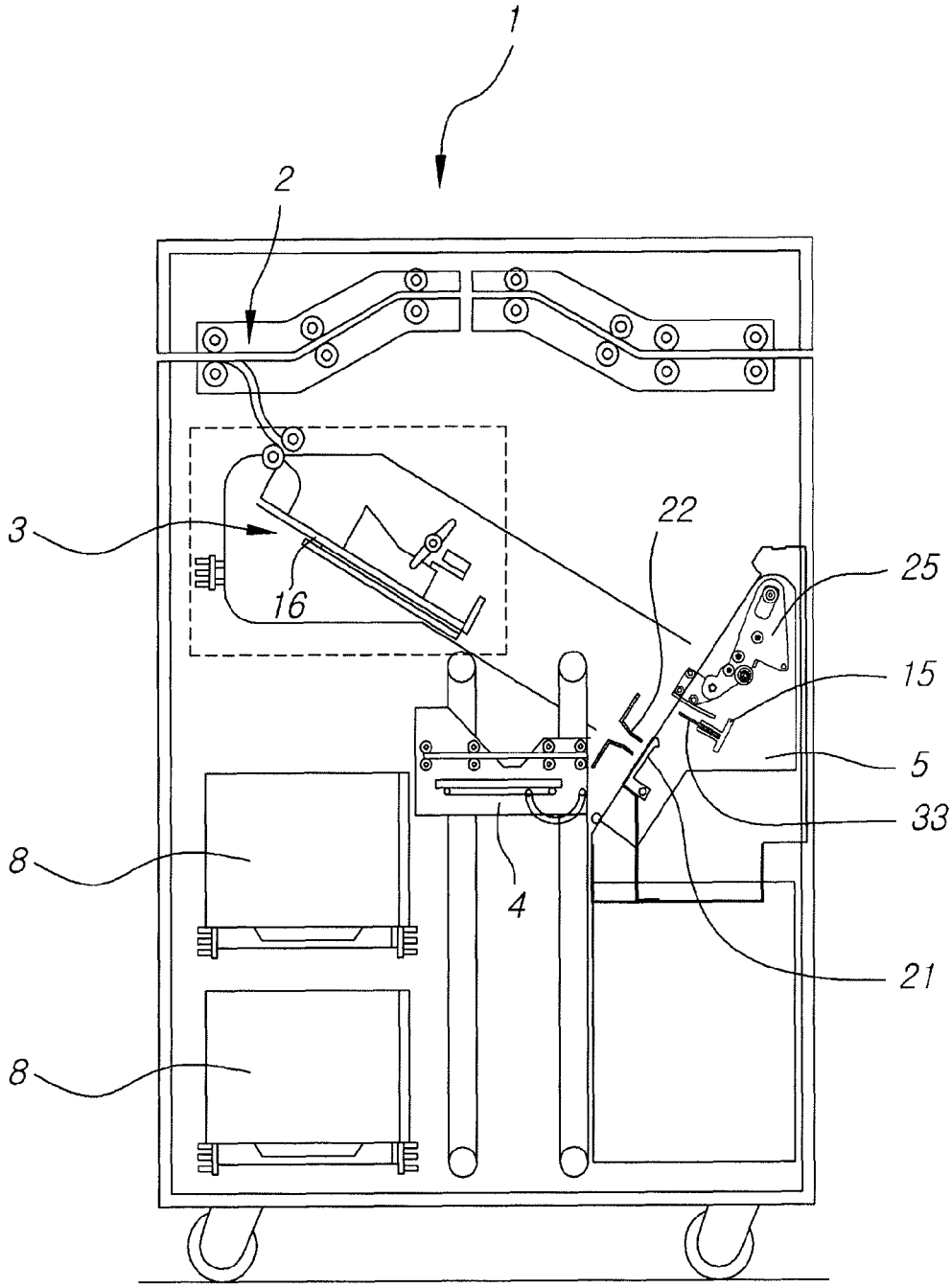

【FIG 2】
PRIOR ART
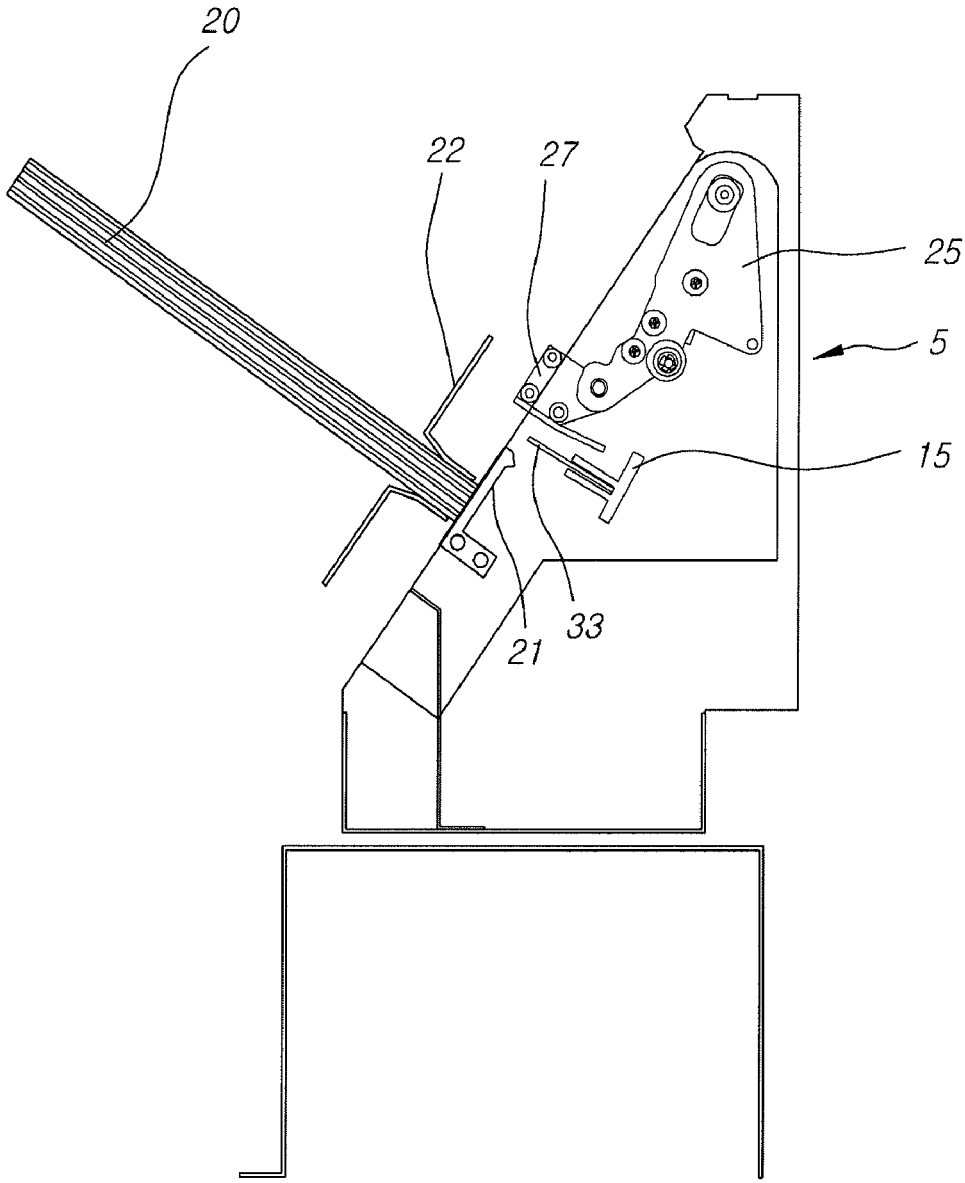

【FIG 3】
PRIOR ART
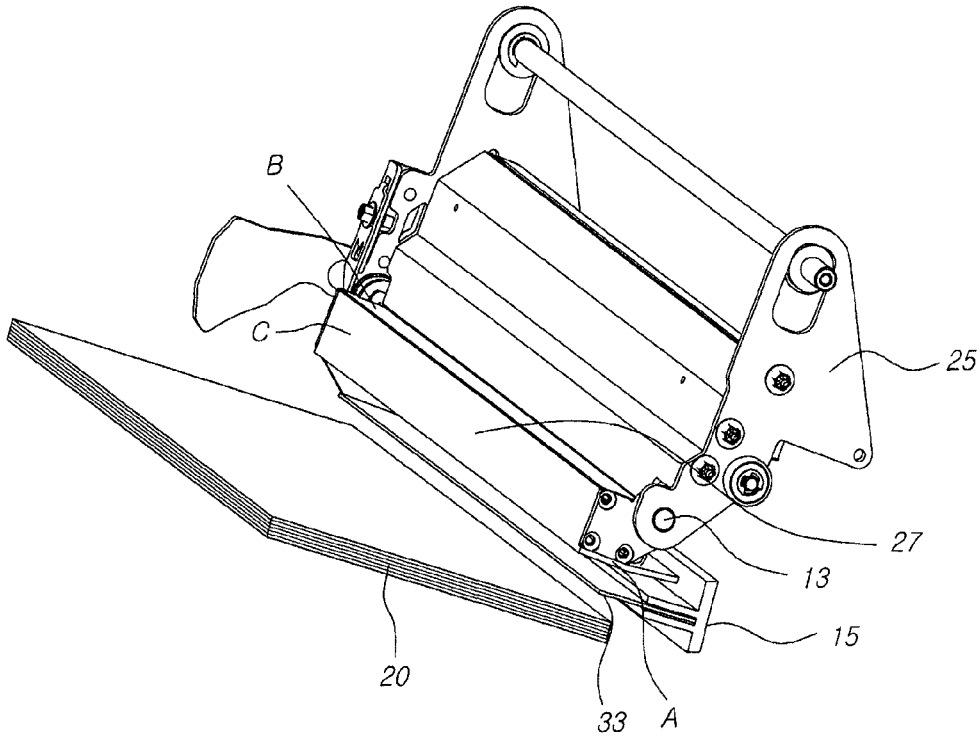
【FIG 4】
PRIOR ART
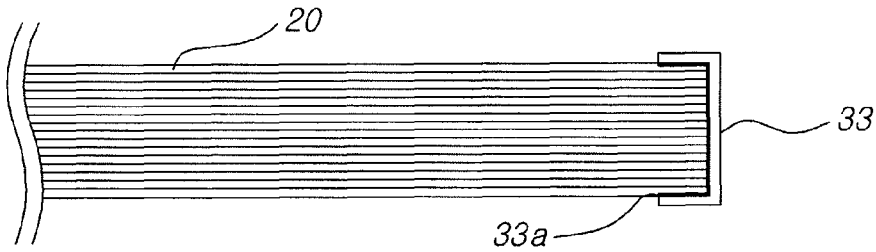

【FIG 5】
PRIOR ART
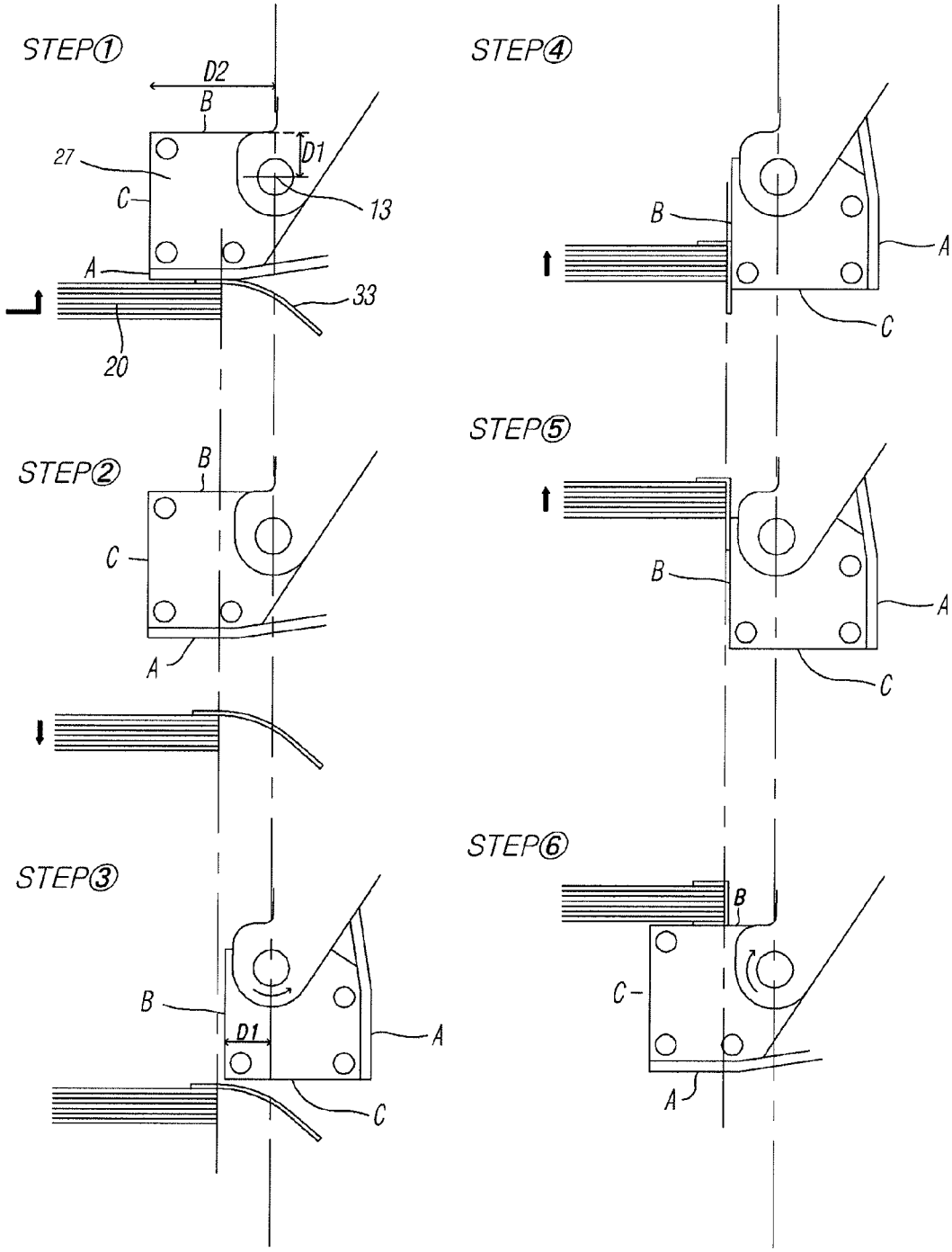

【FIG 6】
PRIOR ART
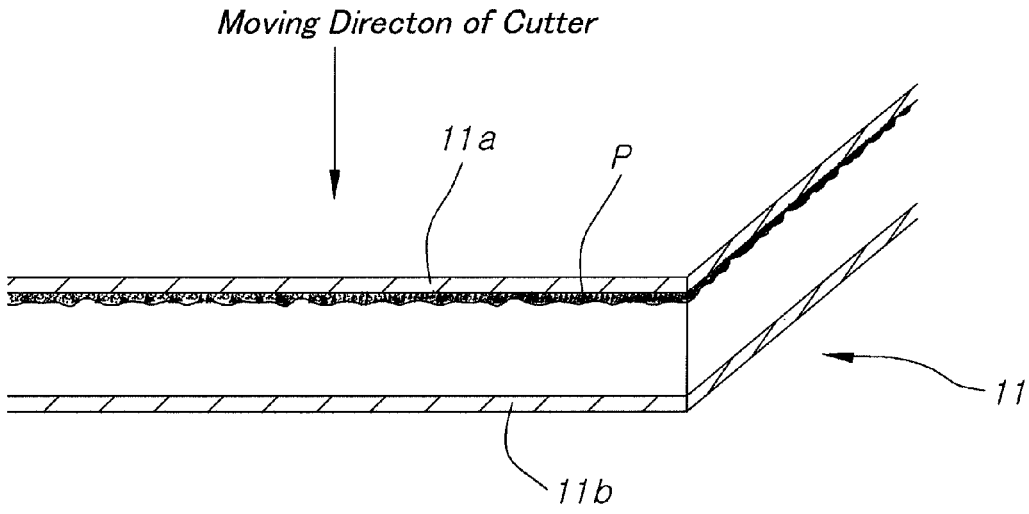

【FIG 7】
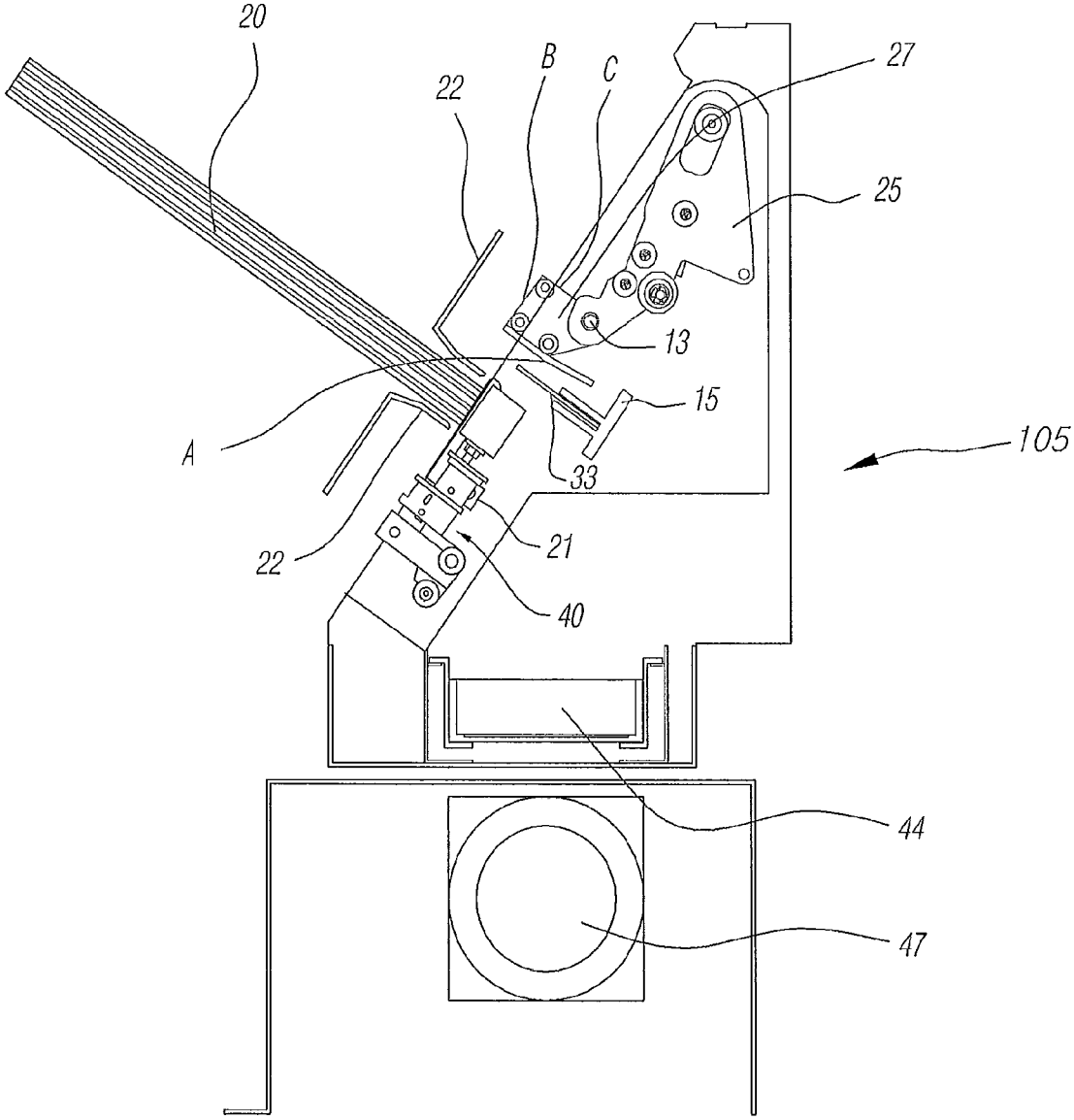

【FIG 8】
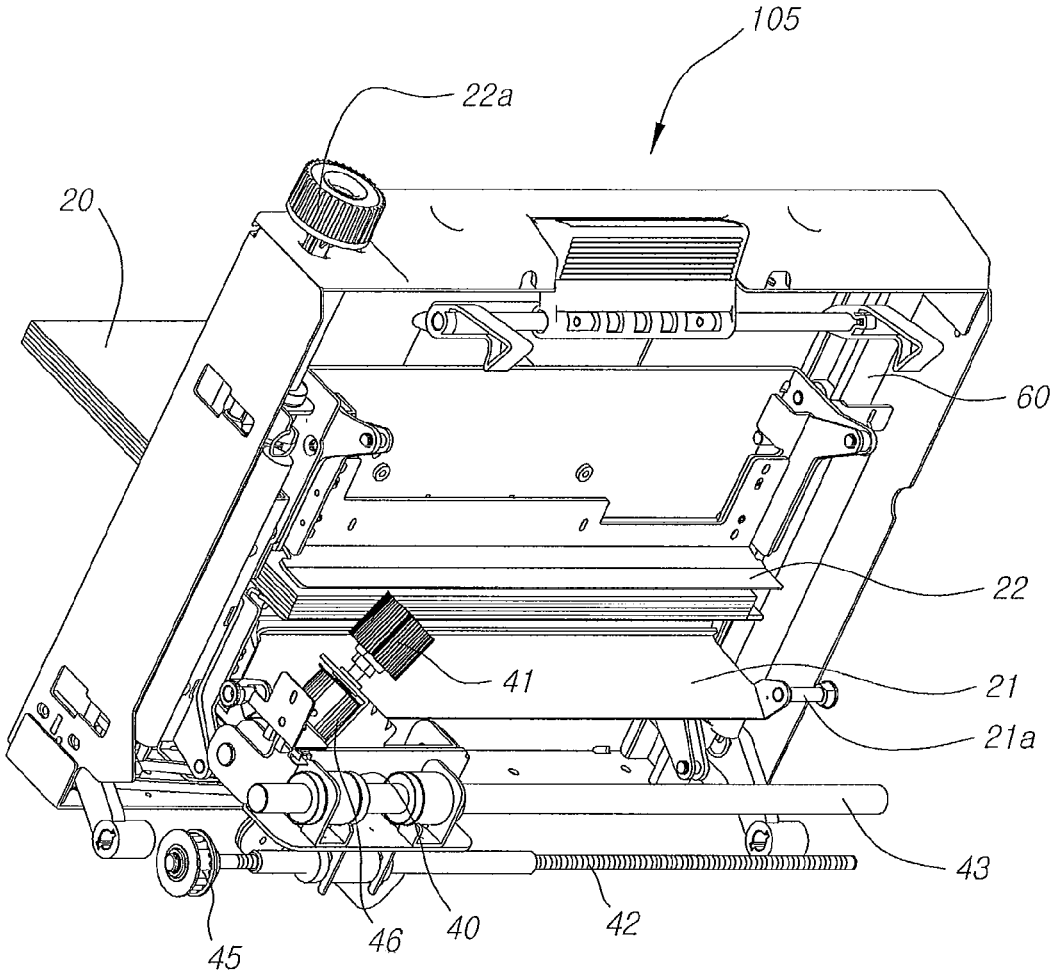

【FIG 9】
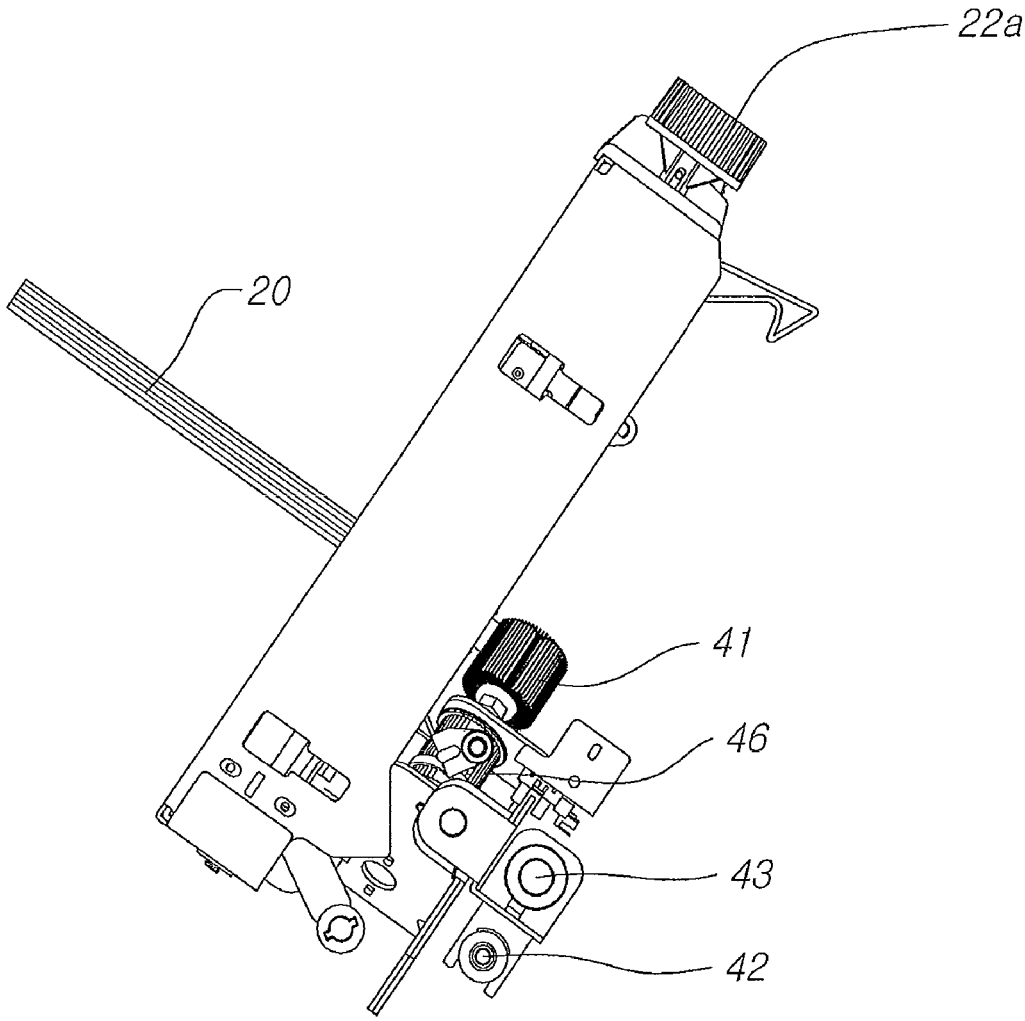

【FIG 10】
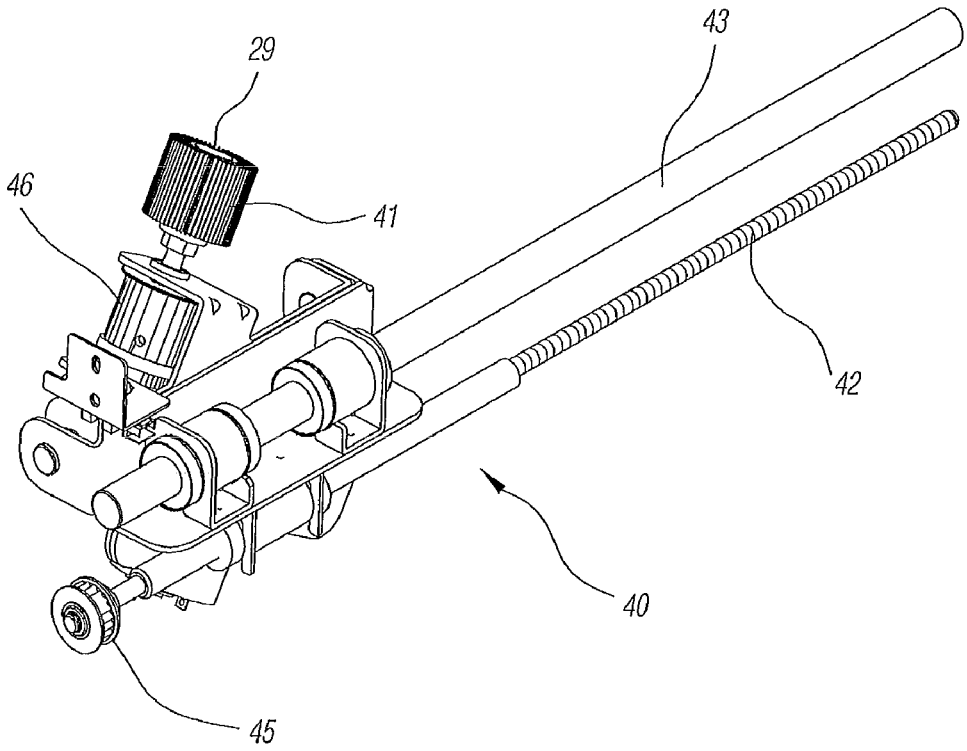

【FIG 11】
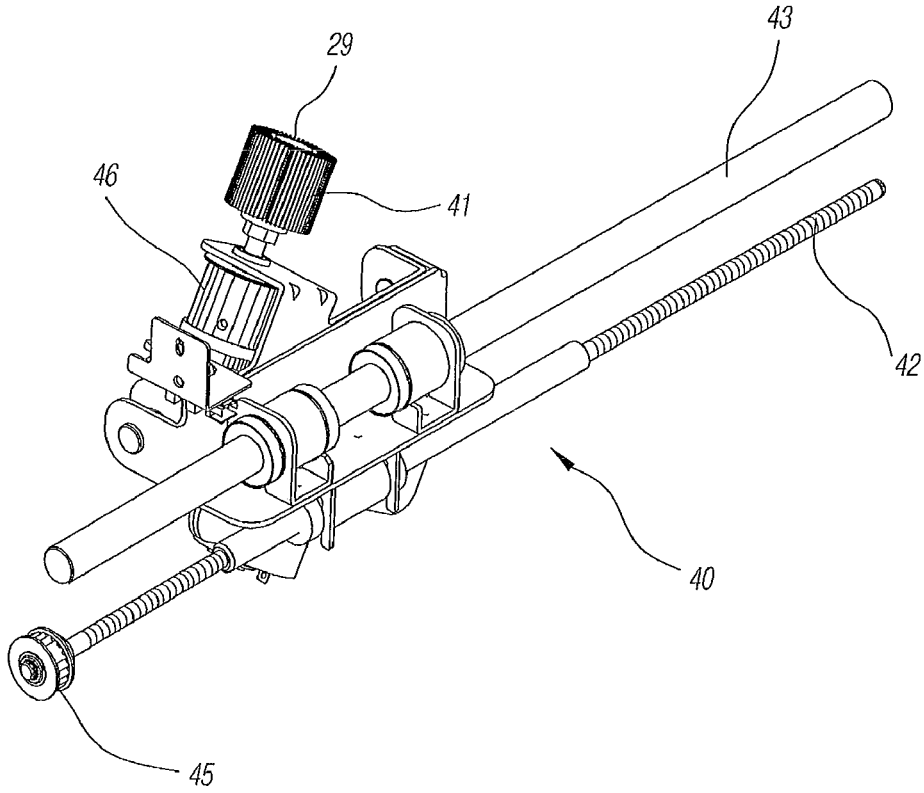

【FIG 12a】
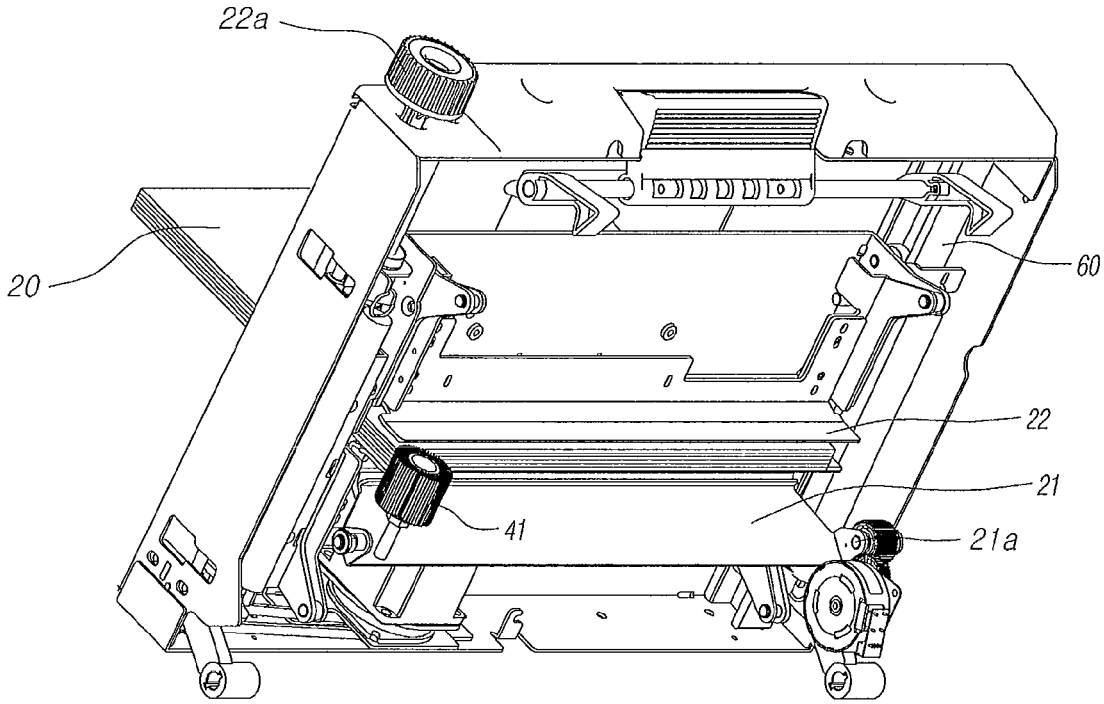

【FIG 12b】
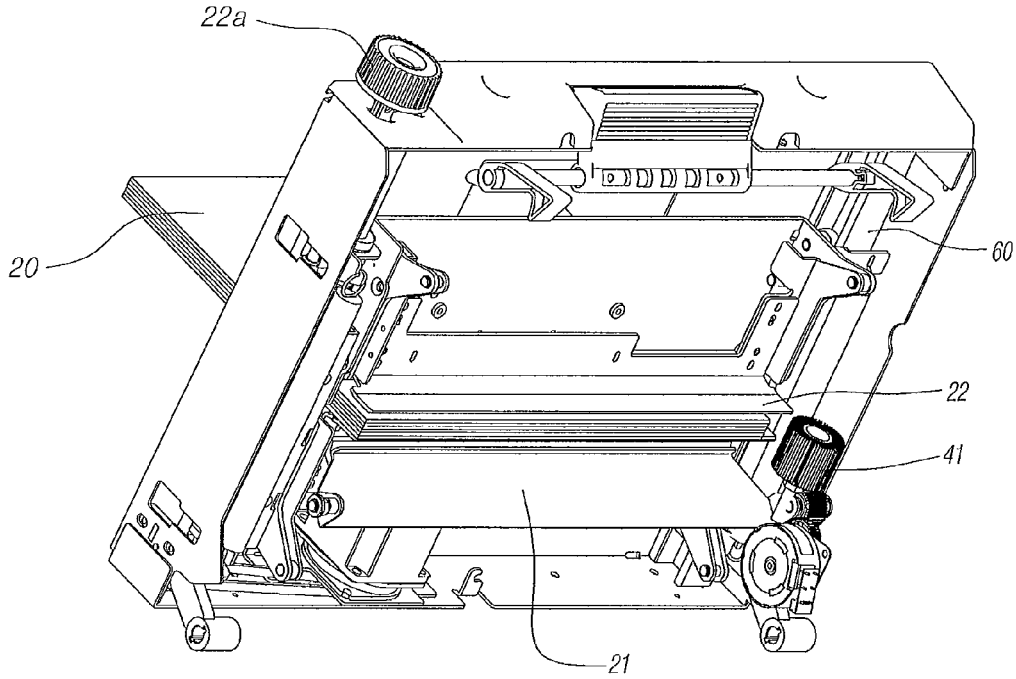

【FIG 13】
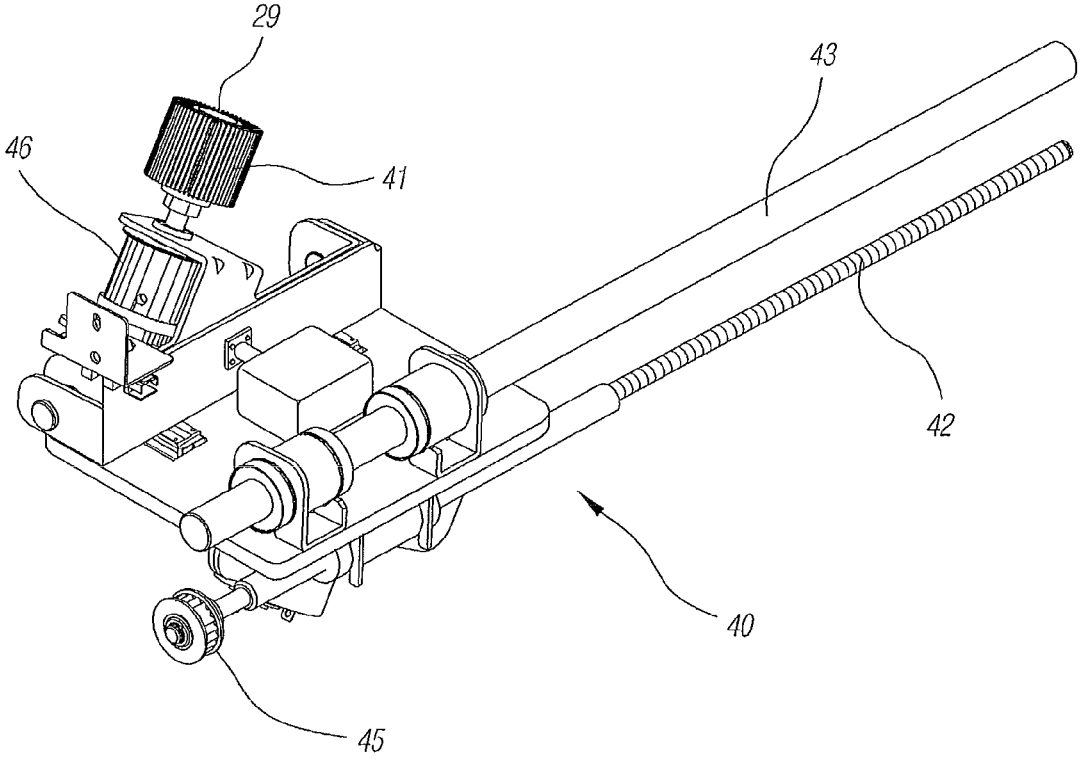

BOOK BINDING DEVICE

BACKGROUND OF THE INVENTION

1. Field of the Invention

The present invention relates to a book binding device that binds papers ejected from a sheet processing unit such as a printer and a copy machine, and more particularly, to a milling unit of a book binding device, which removes a coating material adhered to cutting surfaces of coating sheets before a tape is adhered to the coating sheets so as not to generate any adhesion defect of the tape due to the coating material remaining on the cutting surfaces of the coating sheets during binding of the coating sheets.

2. Discussion of the Related Art

Generally, a sheet processing unit 1, as illustrated in FIG. 1 and FIG. 4, includes a sheet carrying unit 2, a sheet aligning unit 3, a binding product conveying unit 4, a receiving stacker 8, and a binding device 5. If sheets are carried in toward the sheet aligning unit 3 through the sheet carrying unit 2, a predetermined number of sheets are stacked on a tray 16 and then are fed to the binding device 5. Ends of a bunch of the sheets fed to the binding device are aligned based on a sheet aligning plate 21 and then are subjected to binding in a state that the sheets are fixed by a gripper 22.

After the bunch of sheets 20 is moved to the binding device, a binding tape 33 is fed to a tape heating unit 25, and heat is given to the tape fed to the tape heating unit so that an adhesive surface 33*a* of the tap is adhered to the end of the bunch of sheets 20, whereby a binding process of the bunch of sheets is performed.

The table heating unit 25 of the conventional book binding device, as illustrated in FIG. 3 and FIG. 5, includes a square shaped heater 27 provided to rotate based on a support shaft 13. The square shaped heater 27 includes planes A, B and C orthogonal to one another, wherein the plane B opposes the plane A, and the places C and B are selectively located on a front surface by rotation of the support shaft 13.

Furthermore, it is configured that the distance D1 between the plane B and the support shaft 13 is smaller than the distance D1 between the plane C and the support shaft 13.

In a state that the plane C of the heater 27 is located on the front surface, the tape 33 is fed to a place substantially parallel with the plane A of the heater through a tape feeding unit 15. After the bunch of sheets 20 is moved to an adhesion place of the tape 33 in a state that the bunch of sheets 20 is gripped by a gripper (not shown), the end of the bunch of sheets 20 is tightly adhered to the plane A of the heater 27 together with the tape 33.

If a part of the tape 33 is pressed by the plane A of the heater 27 and adhered to the end of the bunch of sheets 20, the tape feeding unit 15 moves to its original place so as not to disturb the binding process.

The binding process will be described in more detail. As illustrated in step ① of FIG. 5, the tape 33 is pressed onto the plane A of the heated heater 27 and welded to a top end of the bunch of sheets 20.

Subsequently, after the tape feeding unit 15 is moved to its original place, the binding process of the bunch of sheets 20 is performed by the steps of ② descending the bunch of sheets 20 from the heater at a predetermined interval, ③ rotating the heater 20 by 90° toward an arrow so that the plane B is located toward the front surface, ④ welding the tape 33 to a side of the bunch of sheets 20 by ascending the bunch of sheets 20, which has descended at a predetermined interval, toward the heater 27, to weld the tape 33 to a side of the bunch of sheets 20, ⑤ upwardly moving the bunch of sheets 20 of which side is welded to the tape, and ⑥ rotating the heater 27 to its original place to adhere the other end of the bunch of sheets 20 to the tape 33 by means of heat of the plane B.

However, if the coating sheets are subjected to binding using the aforementioned binding device, a part P where a coating material constituting upper and low coating layers 11*a* and 11*b* of the coating sheet 11 is pushed to a lower end layer of the coating sheets by a cutter blade is formed during a cutting process using a cutter. For this reason, a problem occurs in that adhesion between the cutting surface of the coating sheet and the tape is remarkably deteriorated.

SUMMARY OF THE INVENTION

The present invention is directed to a book binding device, which substantially obviates one or more of the problems due to limitations and disadvantages of the related art.

An object of the present invention is to provide a milling unit of a book binding device, which removes a coating material adhered to cutting surfaces of coating sheets before a tape is adhered to the coating sheets, thereby increasing an adhesive surface between the coating sheets and the tape.

Another object of the present invention is to provide a book binding device that does not reduce adhesion of a tape and binding quality even in the case that a binding process is performed using coating sheets.

Other object of the present invention is to provide a milling unit of a book binding device, which can selectively mill a section of a tape adhesive part of a bunch of binding sheets in accordance with general sheets or coating sheets.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a book binding device binding a bunch of sheets fed from a sheet aligning unit comprises a sheet aligning plate aligning a section of the bunch of sheets fed from the sheet aligning unit; a gripper fixing the bunch of sheets aligned by the sheet aligning plate; an adhesive unit feeding an adhesive member to the section of the bunch of sheets to bind the bunch of sheets; and a milling unit milling the section of the bunch of sheets before the bunch of sheets is subjected to binding by the adhesive unit.

The milling unit includes a drum type cutting tool cutting the section of the bunch of sheets, a cutting tool moving rod moving the cutting tool along the section of the bunch of sheets, and a driving motor rotating the cutting tool.

The cutting tool moving rod is provided with an earth powder tub at a lower part.

The earth powder tub is provided with an earth powder suction fan.

The adhesive unit includes a tape feeding unit feeding an adhesive tape to the section of the bunch of sheets, and a tape heating unit heating the tape fed by the tape feeding unit to adhere the tape to the section of the bunch of sheets.

The drum type cutting tool is provided with a plurality of cutting blades arranged radially.

The drum type cutting tool is provided to forward and retract in an orthogonal direction of the cutting tool moving rod, so as to adjust a milling thickness of the bunch of sheets.

According to the book binding device of the present invention, since the milling unit that can mill the section of the bunch of sheets is provide, an adhesion force equivalent to binding of general sheets can be maintained even in the case that coating sheets are subjected to binding, whereby binding quality is not deteriorated.

Also, since the section of the bunch of sheets is cut densely by rotation of the cutting tool when the section of the bunch of sheets is milled, an adhesive area between the adhesive and the bunch of sheets increases, whereby the adhesive force increases.

Finally, it is possible to obtain the book binding device of an improved function without complicating the device or modifying its structure.

It is to be understood that both the foregoing general description and the following detailed description are exemplary and explanatory and are intended to provide further explanation of the invention as claimed.

BRIEF DESCRIPTION OF THE ATTACHED DRAWINGS

The invention will be described in detail with reference to the following drawings in which like reference numerals refer to like elements wherein:

FIG. 1 is a diagram illustrating a structure of a general sheet processing apparatus;

FIG. 2 is a sectional view illustrating a structure of a general binding device;

FIG. 3 is an elevational view illustrating a book binding device that includes a general tape feeding unit and a tape heating unit;

FIG. 4 is a diagram illustrating a binding state of a bunch of general sheets;

FIG. 5 is a diagram illustrating a binding process using a general book binding device;

FIG. 6 is a diagram illustrating a sectional structure of a general coating sheet;

FIG. 7 is a sectional view illustrating a book binding device according to the present invention;

FIG. 8 is an elevational view illustrating a coupling structure of a milling unit, a sheet aligning plate and a gripper of a book binding device according to the present invention;

FIG. 9 is a side view of FIG. 8;

FIG. 10 is an elevational view illustrating a milling unit of a book binding device according to one embodiment of the present invention;

FIG. 11 is an elevational view illustrating a state that a drum type cutting tool of a milling unit according to the present invention is moved along a cutting tool moving rod;

FIG. 12*a* and FIG. 12*b* are diagrams illustrating an operation procedure of a milling unit according to the present invention; and FIG. 13 is an elevational view illustrating a milling unit of a book binding device according to another embodiment of the present invention.

| *Description of reference numerals of main parts in the drawings | |
|---|---|
| 1 | sheet processing unit |
| 2 | sheet carrying unit |
| 3 | sheet aligning unit |
| 4 | binding product conveying unit |
| 5, 105 | binding device |
| 8 | receiving stacker |
| 13 | support shaft |
| 15 | tape feeding unit |

-continued

| *Description of reference numerals of main parts in the drawings | |
|---|---|
| 16 | tray |
| 20 | bunch of sheets |
| 21 | sheet aligning plate |
| 22 | gripper |
| 22a | gripper ascending rotational shaft |
| 25 | tape heating unit |
| 27 | heater |
| 29 | cutting blade |
| 33 | tape |
| 33a | adhesive |
| 40 | milling unit |
| 41 | drum type cutting tool |
| 42 | cutting tool moving rod |
| 43 | support rod |
| 44 | earth powder tub |
| 45 | pulley |
| 46 | driving motor |
| 47 | earth powder suction fan |

DETAILED DESCRIPTION OF THE PREFERRED EMBODIMENTS

Reference will now be made in detail to the preferred embodiments of the present invention, examples of which are illustrated in the accompanying drawings.

Hereinafter, technical configuration and operation of a book binding device according to the present invention will be described with reference to FIG. 7 to FIG. 13.

FIG. 7 is a sectional view illustrating a book binding device according to the present invention;

FIG. 8 is an elevational view illustrating a coupling structure of a milling unit, a sheet aligning plate and a gripper of a book binding device according to the present invention;

FIG. 9 is a side view of FIG. 8;

FIG. 10 is an elevational view illustrating a milling unit of a book binding device according to one embodiment of the present invention;

FIG. 11 is an elevational view illustrating a state that a drum type cutting tool of a milling unit according to the present invention is moved along a cutting tool moving rod;

FIG. 12*a* and FIG. 12*b* are diagrams illustrating an operation procedure of a milling unit according to the present invention; and FIG. 13 is an elevational view illustrating a milling unit of a book binding device according to another embodiment of the present invention.

In FIG. 8 and FIG. 9, a tape feeding unit and a tape heating unit are not illustrated to avoid complexity of the drawings.

A book binding device 105 according to the present invention, as illustrated in FIG. 7 to FIG. 11, includes a sheet aligning plate 21, a gripper 22, a tape feeding unit 15, a tape heating unit 25, and a milling unit 40.

The sheet aligning plate 21 aligns the end of a bunch of sheets 20 fed to the binding device, and is fixed to a rotational shaft 21*a* to rotatably move to a place where adhesion of a tape 33 is not disturbed when the tape 33 is adhered to the end of the bunch of sheets 20. In other words, if the bunch of sheets 20 descends without being gripped by the gripper 22 after passing through the gripper 22 in a state that the sheet aligning plate 21 is rotated to allow its plane to be parallel with the end surface of the bunch of sheets, the sheet aligning plate 21 serves to align the end of the bunch of sheets. After the end of the bunch of sheets 20 is aligned in contact with the sheet aligning plate 21, the gripper 22 fixes the aligned end of the bunch of sheets 20 by gripping it. Then, if a gripper ascending rotational shaft 22*a* is driven to upwardly move the gripper 22, which grips the bunch of sheets 20, along an ascending guide 60, the sheet aligning plate 21 rotatably moves to a place below the gripper 22.

If the gripper 22 that fixes the bunch of sheets 20 as above ascends and the sheet aligning plate 21 rotates to expose the gripped end of the bunch of sheets 20, the milling unit 40 is driven to mill the end surface of the bunch of sheets 20.

The mill unit 40 includes a drum type cutting tool 41, a cutting tool moving rod 42 constituting a moving path of the cutting tool, and a driving motor 46 driving the cutting tool. The cutting tool moving rod 42 includes a screw type rod, and rotates by means of a rotation force of a belt (not shown) secured to a pulley 45 to move the drum type cutting tool 41 in parallel with the cutting tool moving rod 42 in both directions.

A support rod 43 supported in parallel with the upper part of the cutting tool moving rod 42 serves to firmly support the drum type cutting tool 42 when the drum type cutting tool 42 moves in both directions, thereby guiding the drum type cutting tool 42 to slidably move.

The drum type cutting tool 41 is provided with a plurality of cutting blades 29 radially arranged. If the end of the bunch of sheets is exposed after the sheet aligning plate 21 is rotated in a state that the drum type cutting tool 41 is located at the end of a side of the bunch of sheets 20, the drum type cutting tool 41 rotates with moving to the right side along the cutting tool moving rod 42 and the support rod 43 to uniformly and densely mill the gripped end of the bunch of sheets 20 at about 0.2~0.3 mm, thereby removing the coating material P adhered to the end of the bunch of sheets.

Rotation of the drum type cutting tool 41 is performed by the driving motor 46.

Of course, if the bunch of sheets is not the bunch of coating sheets, the milling unit 40 of the present invention can be maintained in a standby mode without being driven.

Furthermore, the structure of the milling unit 40 according to the present invention as illustrated in FIG. 7 to FIG. 11 has been described that the drum type cutting tool 41 moves in both directions only and movement to the end of the bunch of sheets, i.e., milling thickness (width) of the end of the bunch of sheets is not adjusted optionally. However, the structure of the milling unit 40 is not limited to the structure illustrated in FIG. 7 to FIG. 11, and its design may be modified in such a manner that a separate moving unit and rail are provided as illustrated in FIG. 13 so as to move the cutting tool 41 to move the end of the bunch of sheets.

In order that a worker optionally adjusts the milling thickness of the bunch of sheets, a technical mechanism that can forward and retract the drum type cutting tool 41 in an orthogonal direction of the cutting tool moving rod 42 is additionally required. For example, the technical mechanism can be configured in the structure of FIG. 13.

An earth powder tub 44 can be provided at a lower region of the cutting tool moving rod 42 of the aforementioned milling unit. The earth powder tub 44 can be provided with an earth powder suction fan 47 that sucks the earth powder cut by the cutting tool to store the sucked earth powder therein.

After the aforementioned milling unit 40 is driven, the milling unit 40 moves to its original place, and the binding process of adhering the tape 33 to the end of the bundle of sheets is performed using the tape feeding unit 15 and the tape heating unit 25.

The tape feeding unit 15 and the tape heating unit 25 constituting the adhesive unit are not limited to the structure illustrated in FIG. 3 and FIG. 5. All types of units that can bind the bunch of sheets 20 using the adhesive can be used as the tape feeding unit 15 and the tape heating unit 25, and can be applied to the book binding device of the present invention.

The operation of the aforementioned milling unit 40 according to the present invention will be described in detail with reference to FIG. 12*a* and FIG. 12*b*.

First of all, FIG. 12*a* illustrates a state before the drum type cutting tool 41 of the milling unit according to the present invention is driven. The sheet aligning plate 21 is detached from the end of the bunch of sheets 20 and then located below the gripper 22.

If the end of the bunch of sheets 20 is fixed by the gripper 22 and then exposed, the drum type cutting tool 41 of the milling unit starts to be driven.

When the gripper 22 that has fixed the bunch of sheets 20 moves to the height position of the drum type cutting tool 41, it is preferable to obtain a sufficient rotation space so that the sheet aligning plate 21 is rotated without being gripped by the gripper 22 to expose the end of the bunch of sheets. However, if the sufficient rotation space is not obtained due to a wide width of the sheet aligning plate 21, the gripper 22 may ascend sufficiently and then the sheet aligning plate 21 may rotate. Subsequently, if the end of the bunch of sheets fixed by gripper is exposed as the sheet aligning plate 21 rotates, the gripper 22 may descend to the height position of the drum type cutting tool 41.

If the end of the bunch of sheets 20 gripped at the height of the drum type cutting tool 41 moves, the drum type cutting tool 41 rotates to mill the end of the bunch of sheets at 0.2!0.3 mm and moves to the right side as illustrated in FIG. 12*b*.

After the end of the bunch of sheets is milled as above, the binding process of adhering the tape 33 to the end of the bunch of sheets is performed in the same manner as the related art.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A book binding device binding a bunch of sheets fed from a sheet aligning unit, the book binding device comprising:

a sheet aligning plate aligning a section of the bunch of sheets fed from the sheet aligning unit;

a gripper fixing the bunch of sheets aligned by the sheet aligning plate;

an adhesive unit feeding an adhesive member to the section of the bunch of sheets to bind the bunch of sheets; and a milling unit milling the section of the bunch of sheets before the bunch of sheets is subjected to binding by the adhesive unit, wherein the milling unit includes:

a cutting tool cutting the section of the bunch of sheets;

a cutting tool moving rod moving the cutting tool along the section of the bunch of sheets;

a driving motor rotating the cutting tool; and an earth powder tub under the cutting tool.

2. The book binding device as claimed in claim 1, wherein the earth powder tub is provided with an earth powder suction fan.

* * * * *